US006266846B1

(12) United States Patent
Chan

(10) Patent No.: US 6,266,846 B1
(45) Date of Patent: Jul. 31, 2001

(54) VACUUM CLEANER

(75) Inventor: Ka Ming Chan, Hong Kong (HK)

(73) Assignee: Talentone Development Limited, Hong Kong (HK)

( * ) Notice: Subject to any disclaimer, the term of this patent is extended or adjusted under 35 U.S.C. 154(b) by 0 days.

(21) Appl. No.: 09/557,507

(22) Filed: Apr. 25, 2000

(51) Int. Cl.[7] ..... A47L 5/24
(52) U.S. Cl. ..... 15/399; 15/344; 15/DIG. 1
(58) Field of Search ..... 15/398, 399, 400, 15/344

(56) References Cited

U.S. PATENT DOCUMENTS 673,603 * 5/1901 Harvey ..... 15/399
1,345,424 * 7/1920 Wasenska ..... 15/398 X
2,089,600 * 8/1937 Edwards ..... 15/399
2,469,256 * 5/1949 Brakman ..... 15/398
2,730,753 * 1/1956 Gerber ..... 15/399
3,835,869 * 9/1974 Newman et al. ..... 15/400 X
5,386,607 * 2/1995 Sebor ..... 15/400 X
5,706,550 * 1/1998 Holsten ..... 15/400
5,850,669 * 12/1998 Schupp et al. ..... 15/398 X

* cited by examiner

*Primary Examiner*—Chris K. Moore
(74) *Attorney, Agent, or Firm*—Jackson Walker L.L.P.

(57) ABSTRACT

A vacuum cleaner head carries an array of brush bristles in conventional fashion. The bristles surround an inlet through which dust and debris are sucked into the vacuum cleaner during normal brushing action. A skirt is mounted inside the bristles so that when the head is pressed sufficiently towards a brushing surfaces a lower edge of the skirt can contact directly against the brushing surface.

1 Claim, 2 Drawing Sheets

VACUUM CLEANER

BACKGROUND OF THE INVENTION

1. Field of the Invention

The invention relates to vacuum cleaners.

2. Description of the Prior Art

The invention is particularly but not exclusively related to a hand-holdable vacuum cleaner with a rechargable battery power pack. In normal use an array of bristles are used to brush surfaces and a vacuum applied centrally within the array to suck dust and debris disturbed by the brushing into an inlet in the body of the cleaner for collection and later disposal. Different types of vacuum (sucking) arrangements can be used and are well-known. As the vacuum is applied in effect well inside the array, the actual vacuum (or sucking) is partially wasted due to lateral air flow between the bristles well above the ends of the bristles.

SUMMARY OF THE INVENTION

It is an object of the invention to overcome or at least reduce this problem.

According to the invention there is provided a vacuum cleaner having a housing which has a lower generally planar surface and a central inlet to which a vacuum is applied to draw dust and debris into the housing for collection, a brush head that fits against the planar surface and carries an array of brush bristles surrounding the central inlet with the bristles extending downwards from the planar surface for contacting a brushing surface in use, including a skirt surrounding the inlet that extends downwards inside the array of bristles with a peripheral bottom edge, adjacent the bristles, that can be contacted directly against the brushing surface when the head is pressed sufficiently firmly downwards to laterally flex the bristles.

The array of bristles and the skirt may be rectangularly shaped in plan.

The skirt may be formed of plastics material. The skirt may be formed of flexible material. The skirt may be integrally formed with the brush head.

The skirt is preferably formed with vertical slits to allow the bottom edge to flex so as to conform to non-planar brushing surfaces when required.

BRIEF DESCRIPTION OF THE DRAWINGS

A vacuum cleaner according to the invention will now be described by way of example with reference to the accompanying drawings in which.

DESCRIPTION OF THE PREFERRED EMBODIMENT

Figure 1:
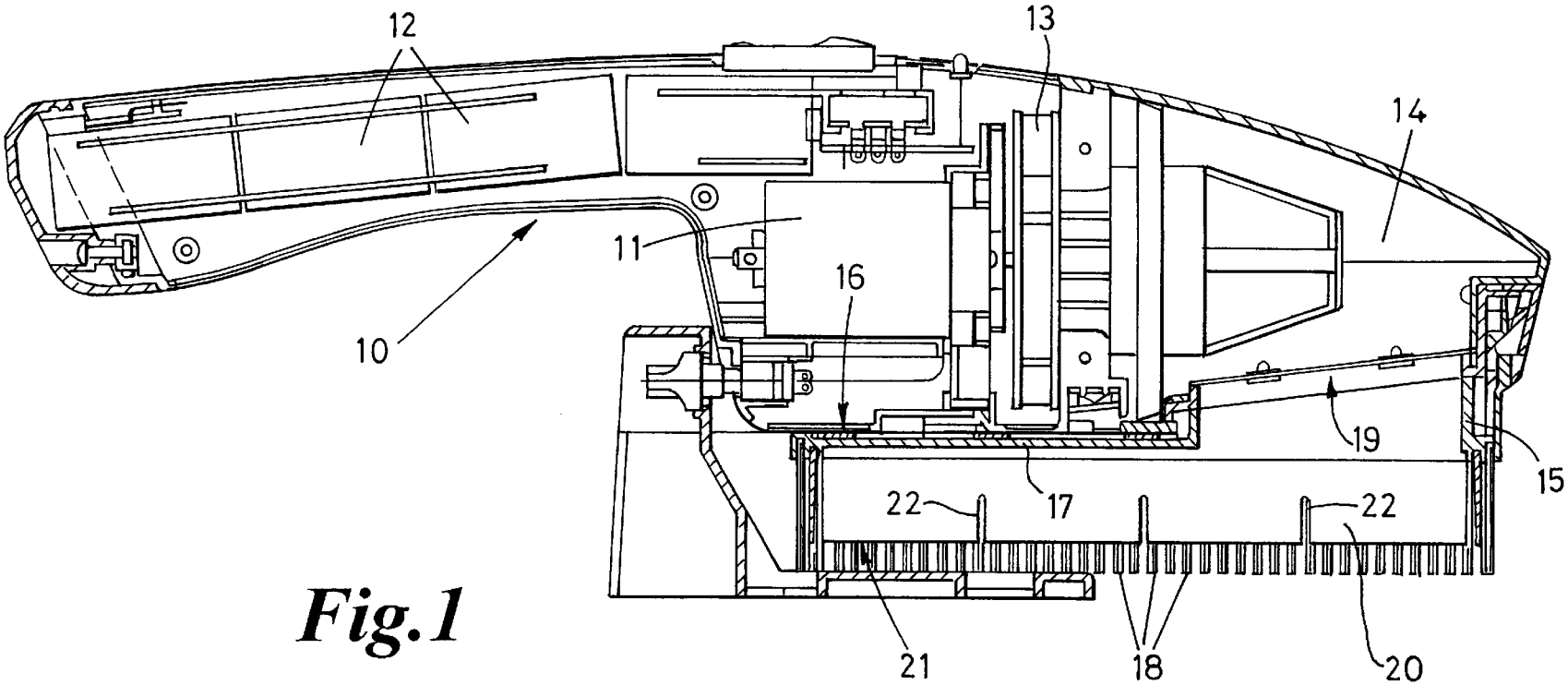
FIG. 1 is a sectional side view of the vacuum cleaner.
Figure 2:
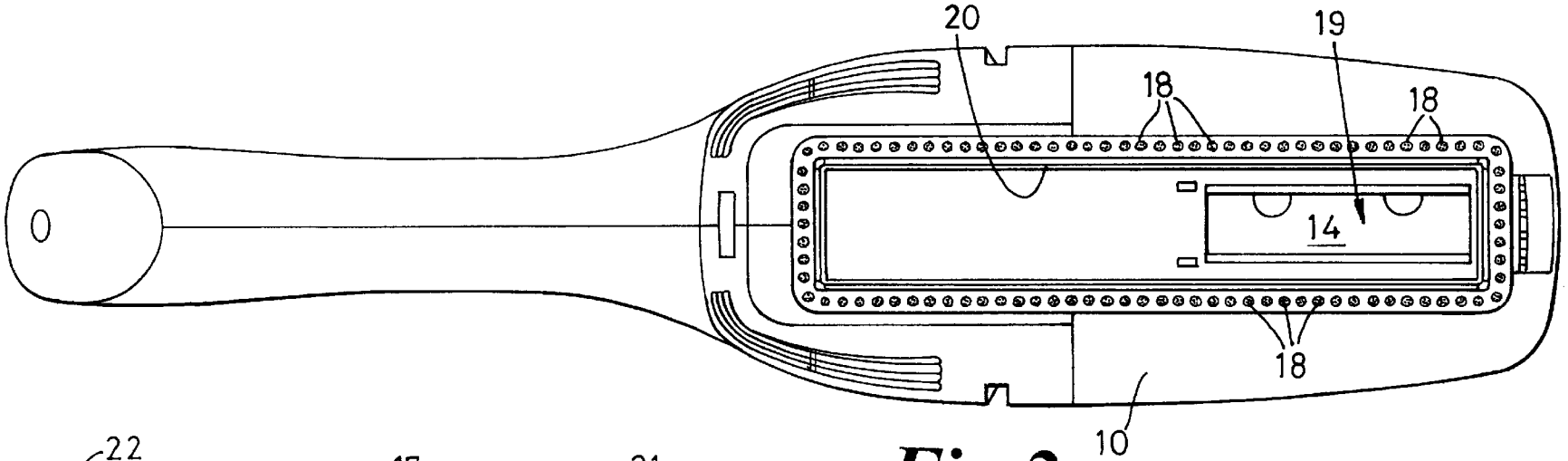
FIG. 2 is a bottom plan view of the vacuum cleaner.

Referring to the drawings, a vacuum cleaner housing 10 incorporates various components which are well known, such as a motor 11, a rechargeable battery pack 12, a turbine impeller 13 and a dust-collecting compartment 14. A platform 15 formed in the housing 10 has a planar exposed lower surface 16. A brush head 17 which carries a rectangular shaped array of brush bristles 18 is releasably clipped against the surface 16 in conventional fashion.

The vacuum cleaner described thus far is well-known and its operation and its characteristics are familiar in the art. In normal use, the vacuum cleaner is manually swept over a brushing surface so that the bristles sweep up dust and debris, which is then drawn into the vacuum cleaner via a central forward inlet 19 in the housing 10. The swept materials are collected in the compartment 14.

Embodiments of the invention include a rectangularly shaped skirt 20 that is attached (or could be integrally formed with) the housing 10 or the head 15 and that extends downwards inside and adjacent the array of bristles 18. A lower peripheral edge 21 of the skirt is positioned for normal sweeping above remote ends of the bristles 18 and the skirt changes little, or does not change generally, the overall characteristics or operation of the vacuum cleaner for normal sweeping. However, the skirt significantly improves the vacuum, or sucking, applied adjacent the swept surface so as to more effectively sweep up the dust and debris disturbed during sweeping. The skirt causes the vacuum to be actually applied relatively close to the swept surface in use and more importantly any flow laterally and through between the bristles 18 is suppressed or significantly reduced. As the bristles are inherently flexible, the vacuum cleaner may be pressed firmly against the swept surface so that the lower peripheral edge of the skirt can press directly against the swept surface to further concentrate the effect of the vacuum (sucking) to remove dust and debris more efficiently.

Vacuum cleaners of the present invention can therefore be used for sweeping in the normal way but have been found to be much more effective in removing the dust and debris because the vacuum created by the impeller 13 is more effectively applied to the swept surface.

The skirt 20 may be made of flexible material such as rubber or plastics that can conform, at least to some extent, to swept surfaces that are non-planar. The lower peripheral edge 21 may be formed with a plurality of narrow slits 22 to allow the skirt to flex more readily and conform to non-planar brushing surfaces when required.

Skirts as described may be provided in like manner for other vacuum cleaners such as "barrel" or "upright" cleaners, where the vacuum cleaner body is not manually carried in use but mounted on wheels or slides. In those cases, a brush head is usually connected to the body by a hose and only the head is manually supported and swept over the brushing surface.

Figure 3:
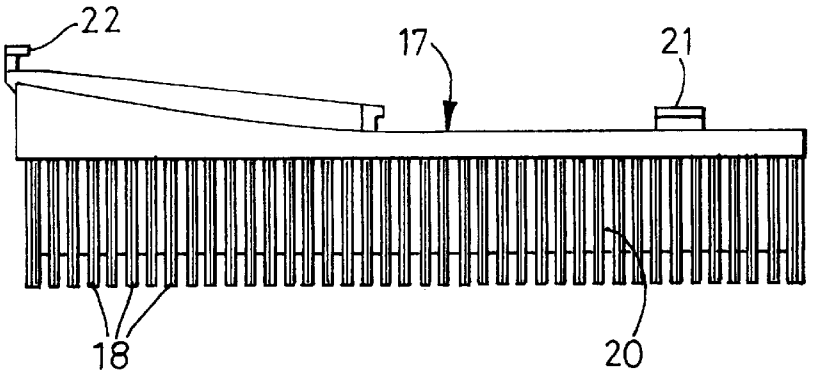
FIG. 3 is a side view of one brush head for the vacuum cleaner.
Figure 4:
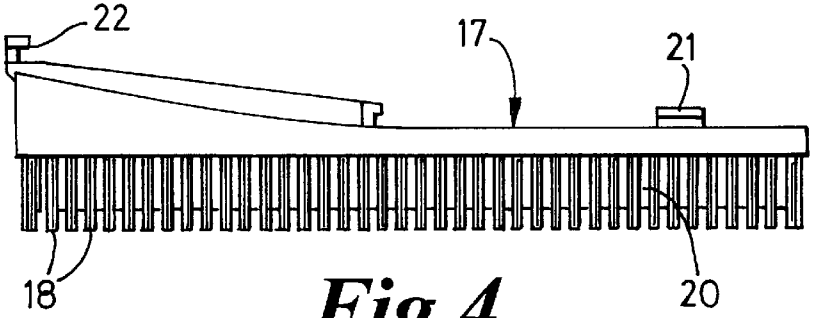
FIG. 4 is a side view of another brush head for the vacuum cleaner.

FIG. 3 shows the brush head of FIG. 1 and FIG. 4 shows another form of brush head. The only difference between the heads is that the bristles in FIG. 3 are longer. In each case, the skirt 20 extends well down towards and adjacent the ends of the respective bristles 18. The brush heads both have suitable clips 21 and 22 that releasably engage in cooperating recesses integrally formed in the housing 10, in a manner well-known in the art.

I claim:

1. A vacuum cleaner comprising:

a housing which has a lower generally planar surface and a central inlet to which a vacuum is applied to draw dust and debris into the housing for collection;

a brush head that fits against the planar surface and carries an array of brush bristles surrounding the central inlet with the bristles extending downwards from the planar surface for contacting a brushing surface in use;

a skirt surrounding the inlet that extends downwards inside the array of bristles with a peripheral bottom edge, adjacent the bristles contacting directly against the brushing surface when the head is pressed sufficiently firmly downwards to laterally flex the bristles, the skirt formed with vertical slits to allow the bottom edge to flex so as to conform to non-planar brushing surfaces when required.

* * * * *